US005863096A

United States Patent [19]

Bartlmae

[11] Patent Number: 5,863,096

[45] Date of Patent: Jan. 26, 1999

[54] STACKABLE AND LATERALLY INTERLOCKABLE CHAIRS

[75] Inventor: Volker Bartlmae, Ulm, Germany

[73] Assignee: Mauser Office GmbH, Korbach, Germany

[21] Appl. No.: 911,255

[22] Filed: Aug. 14, 1997

[30] Foreign Application Priority Data

Aug. 16, 1996 [DE] Germany ..... 196 33 069.6

[51] Int. Cl.[6] ..... A47C 15/00

[52] U.S. Cl. ..... 297/248; 297/239; 297/232

[58] Field of Search ..... 297/248, 239, 297/249, 232

[56] References Cited

U.S. PATENT DOCUMENTS

| | | | |
|---|---|---|---|
| 3,227,487 | 1/1966 | Blanchard, Jr. et al. | 297/248 |
| 3,614,157 | 10/1971 | Hendrickson et al. | 297/248 |
| 3,620,567 | 11/1971 | Hendrickson et al. | 297/248 |
| 3,708,202 | 1/1973 | Barecki et al. | 297/248 X |
| 5,352,017 | 10/1994 | Berning | 297/248 |

*Primary Examiner*—Laurie K. Cranmer
*Attorney, Agent, or Firm*—Herbert Dubno; Andrew Wilford

[57] ABSTRACT

A seating assembly has an armless chair having a frame, floor-engaging legs extending downward from the frame, a generally horizontal seat supported on the frame, and an upright back supported on the frame. The frame defines a pair of opposite sides between which lie the respective frame, legs, seat, and back. An arm chair has a frame, floor-engaging legs extending downward from the frame, a generally horizontal seat supported on the frame, an upright back supported on the frame, and at least one arm fixed to the frame. This frame and arm define a pair of opposite sides between which lie the respective frame, legs, seat, back, and arm. A front female coupling member is fixed on one side of each chair spaced a predetermined vertical front distance from a floor plane defined by the respective feet and a front male coupling member is fixed on the other side of each chair spaced a vertical front distance from the respective plane and engageable in the female member of an adjacent such chair. The frames, members, and arms are so constructed and positioned that the chairs can be nested atop one another.

13 Claims, 7 Drawing Sheets

STACKABLE AND LATERALLY INTERLOCKABLE CHAIRS

FIELD OF THE INVENTION

The present invention relates to a chair. More particularly this invention concerns a chair which can be nested in a stack with other such chairs and which can be laterally interlocked in rows with other such chairs.

BACKGROUND OF THE INVENTION

A standard stackable chair comprises a frame typically made of aluminum or steel tubing and having four floor-engaging legs, a generally horizontal seat, and a generally vertical back. The frames are constructed so that the chairs can be stacked atop one another for storage and transport. Such chairs may also each be equipped with one or two arms.

In order to form orderly rows of such chairs, it is known to provide them with coupling members that allow them to be interlocked one next to the other. With armless chairs such coupling is fairly simple. When the chairs have one arm each, it is possible to form a row with one arm between adjacent chairs. Alternately chairs with two arms can be alternated with armless chairs.

The problem with this system is that stacking the arm chairs, that is the chairs equipped with one or two arms, is somewhat complex, especially when these chairs are also equipped with the above-mentioned coupling members. Accordingly German utility model 89 10 779 describes a system with removable arms. Thus the arms are taken off so that the chairs can be stacked and put back on again when the chairs are to be used. Once the rows are built, the arms are reinstalled. This is obviously an unsatisfactory solution as it requires extra work to take down and set up the chairs, and offers the opportunity to lose the arms when they are separated from the chairs.

Thus German patent 3,933,817 describes a system where chairs having permanent arms are interlocked in rows by means of retractable coupling hooks mounted underneath the seats. These hooks are pulled out to couple the chairs together and pushed back in when they are to be stacked, avoiding the problem of the coupling hooks interfering with the stacking. These coupling hooks have to be differently constructed for arm and armless chairs and add considerably to the cost of the chair. Furthermore if they are not properly retracted, they interfere with stacking, so this solution is also unsatisfactory.

In German patent 3,110,050 the chairs have arms that can be pivoted out of the way for stacking the chairs. Once again this entails an extra operation both on putting away and setting up the chairs, and the pivot structure adds somewhat to the cost of the chairs.

Thus in all the known solutions the arms and/or the coupling elements must be displaced to allow the chairs to stack. Furthermore interconnecting armless chairs with arm chairs is often difficult or impossible, and of course stacking different types of chairs is similarly out of the question.

OBJECTS OF THE INVENTION

It is therefore an object of the present invention to provide an improved stackable and interlockable chair assembly.

Another object is the provision of such an improved stackable and interlockable chair assembly which overcomes the above-given disadvantages, that is which allows chairs with arms and chairs without arms to be coupled together in rows and stacked one atop the other without difficulty.

SUMMARY OF THE INVENTION

A seating assembly has according to the invention an armless chair having a frame, floor-engaging legs extending downward from the frame, a generally horizontal seat supported on the frame, and an upright back supported on the frame. The frame defines a pair of opposite sides between which lie the respective frame, legs, seat, and back. An arm chair has a frame, floor-engaging legs extending downward from the frame, a generally horizontal seat supported on the frame, an upright back supported on the frame, and at least one arm fixed to the frame. This frame and arm define a pair of opposite sides between which lie the respective frame, legs, seat, back, and arm. A front female coupling member is fixed on one side of each chair spaced a predetermined vertical front distance from a floor plane defined by the respective feet and a front male coupling member is fixed on the other side of each chair spaced a vertical front distance from the respective plane and engageable in the female member of an adjacent such chair. The frames, members, and arms are so constructed and positioned that the chairs can be nested atop one another.

With the system of the invention the coupling members fixed on the chairs allow them to be coupled together in a very simple manner but do not interfere with stacking of the chairs. Armless chairs can be interlocked with chairs with one or two arms with no difficulty without in any way manipulating the coupling members and/or arms on the respective chairs.

The assembly is particularly effective when the coupling members are at locations in a region of a stack of the chairs defined by a horizontal extent of the arms and a stack height. In this manner it is possible to form neat rows in a simple manner while still being able to stack armless chairs with arm chairs.

The legs converge generally upwardly at the respective front members. This ensures that a stack of chairs will be stable. This orientation inherently places the coupling members generally level with the chair seats for solid interlocking.

To make a long row it is advantages for each chair to also have a back female coupling member fixed on the one side of each chair spaced a predetermined vertical back distance from the floor plane and a predetermined horizontal distance from the respective front female coupling member and a back male coupling member fixed on the other side of each chair spaced the vertical distance from the respective plane and the horizontal distance from the respective front male coupling member and engageable in the respective back female member of an adjacent such chair. This two-point interconnection allows the chairs to be interlocked into a very rigid row.

The upper members of a chair define an upper axis and the lower members define a lower axis parallel to the upper axis. In addition screws secure the members to the respective frames and arms. This allows the assembly to be made at low cost, since extra long screws are used on arm chairs to secure both the coupling members and arms to the chair frame. Short screws are used on armless chairs or on the armless side of a one-arm chair. The members of the arm chair are thus fixed to the respective arm.

The frames and legs are formed of tubing of a predetermined diameter and the coupling members are of a substantially smaller diameter. Thus the coupling members are quite small and do not create a hazard when the chairs are used individually.

Each male coupling member according to the invention is formed as a pin having a large laterally projecting head and each female coupling member is formed as a complementary laterally open seat. More particularly each seat has a groove receiving the respective head and a laterally open slot and each slot is basically U-shaped.

The slot of at least one of the female members of each chair opens generally vertically. The slot of the other of the female members of each chair opens generally horizontally. More particularly the slots of the rear female members open horizontally forward and the slots of the front female members open vertically downward and backward. This is particularly advantageous in that it prevents the chairs from being disconnected when one chair is pushed horizontally or lifted, since a combination of vertical and horizontal movement is needed to disconnect them.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
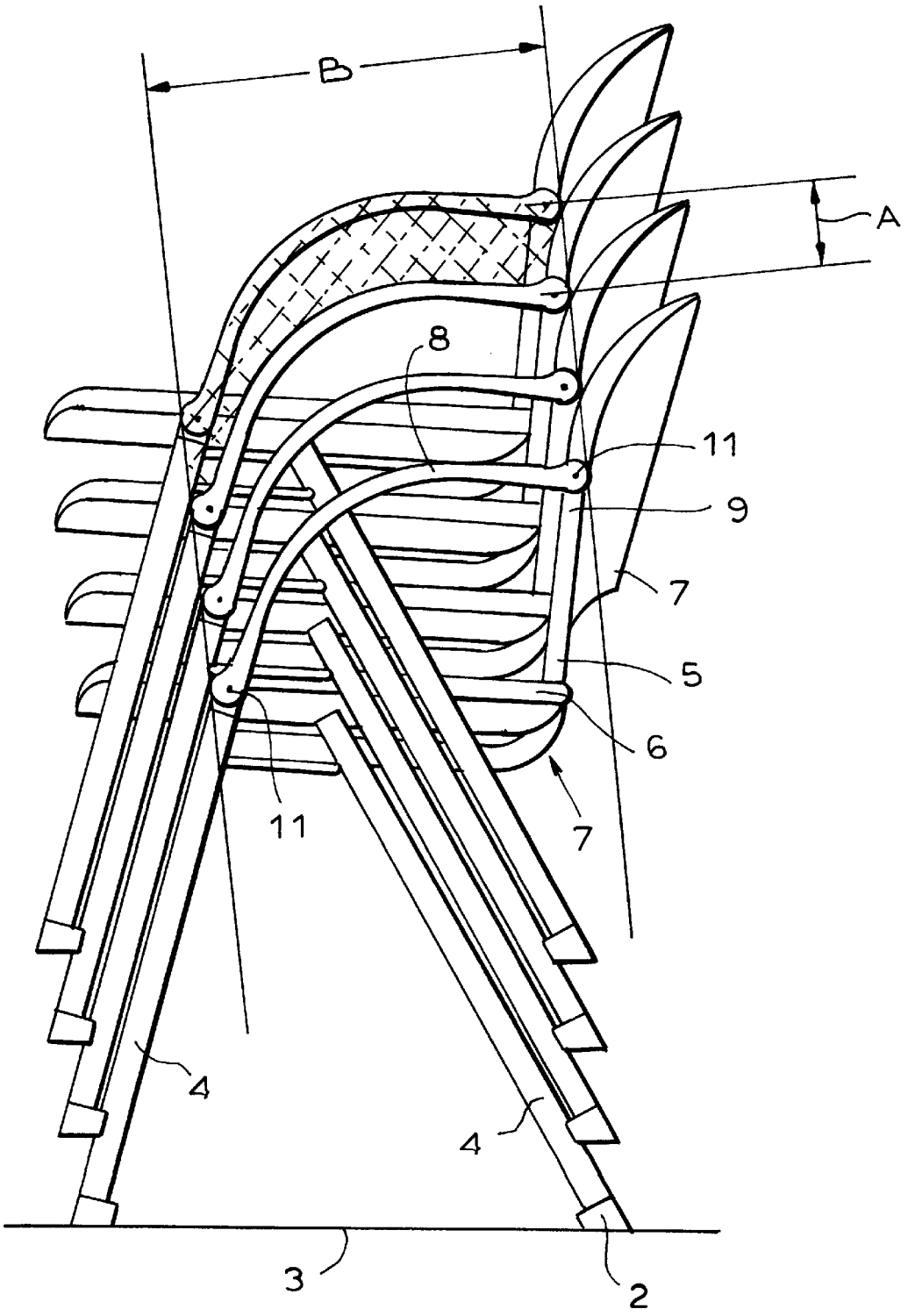
FIG. 1 is a side view of a stack of chairs according to the invention.
Figure 2:
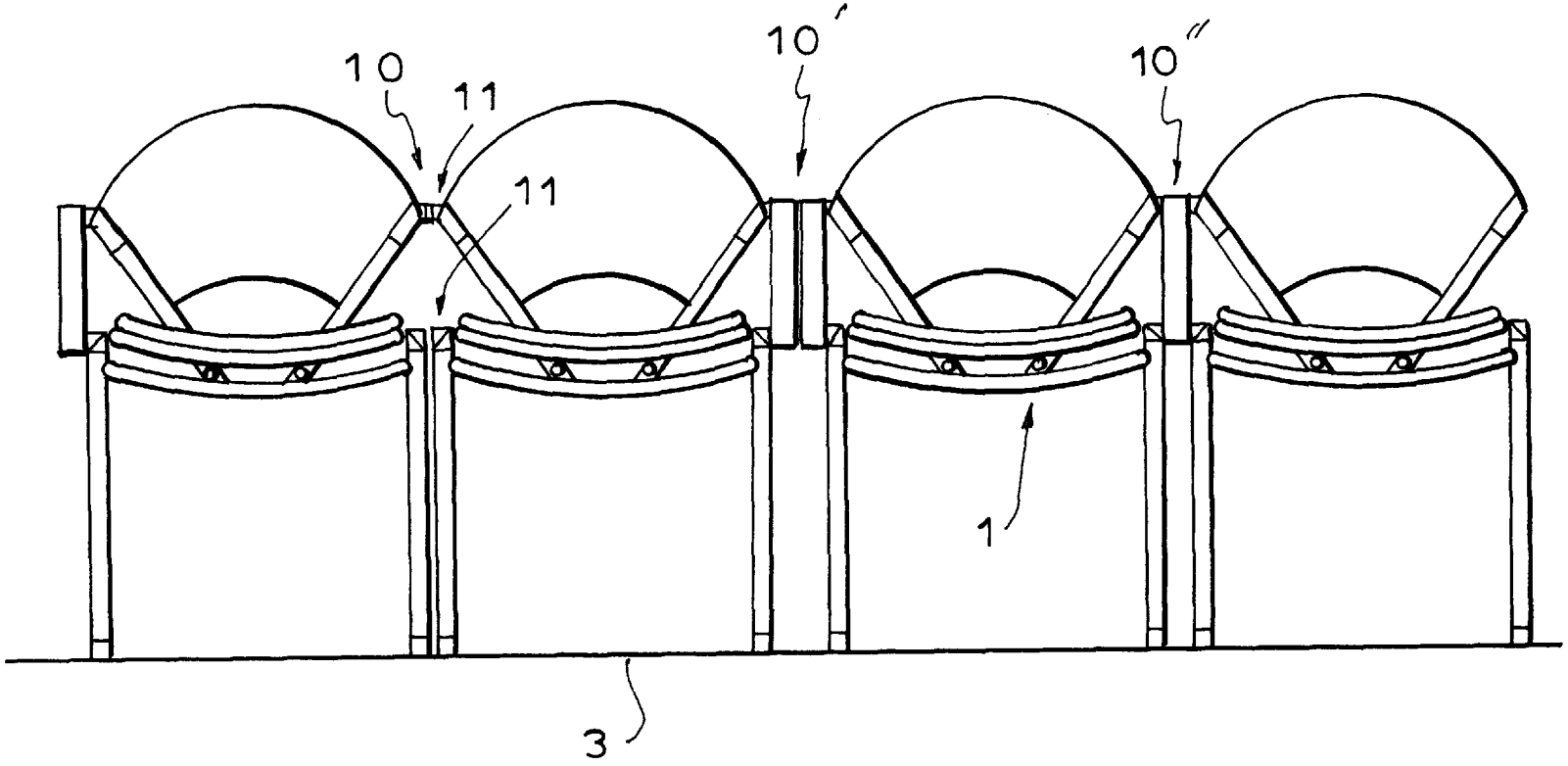
FIG. 2 is a front view of a row of interlocked chairs according to the invention.

As seen in FIGS. 1 and 2 a chair according to the invention comprises a frame 5 normally made of steel or aluminum tubing and having four legs 4 with feet 2 that sit on a planar floor 3. A generally horizontal seat cushion 6 and an upright back cushion 7 are supported on the frame 5. Some of the chairs 1 are provided with one or two arms 8 formed as arcuate elements connected at upper and lower ends to the respective frame 5. The chairs 1 each have a pair of outermost side connection points 11 that are defined by the frame 5 on the chairs 1 without arms 8 and by the arms 8 on the sides of the chairs 1 with arms.

It is possible to stack the chairs 1 atop one another as shown in FIG. 1 with the feet 2 of each chair 1 resting on the legs 4 of the underlying chair 1. Stacking is not impeded by the side points 11 which lie in a region that is defined on one hand by the stack height A and on the other hand by the widest spacing B that is determined by the greatest length of the arm rests 8. The region in which the connecting points 11 must lie so that they do not interfere with stacking is indicated at the top of FIG. 1 by cross hatching. FIG. 2 shows two chair sides with no arms connected together at 10, two chair sides with arms 8 connected together at 10', and one chair side with an arm 8 and one without connected together at 10".

Figure 3:
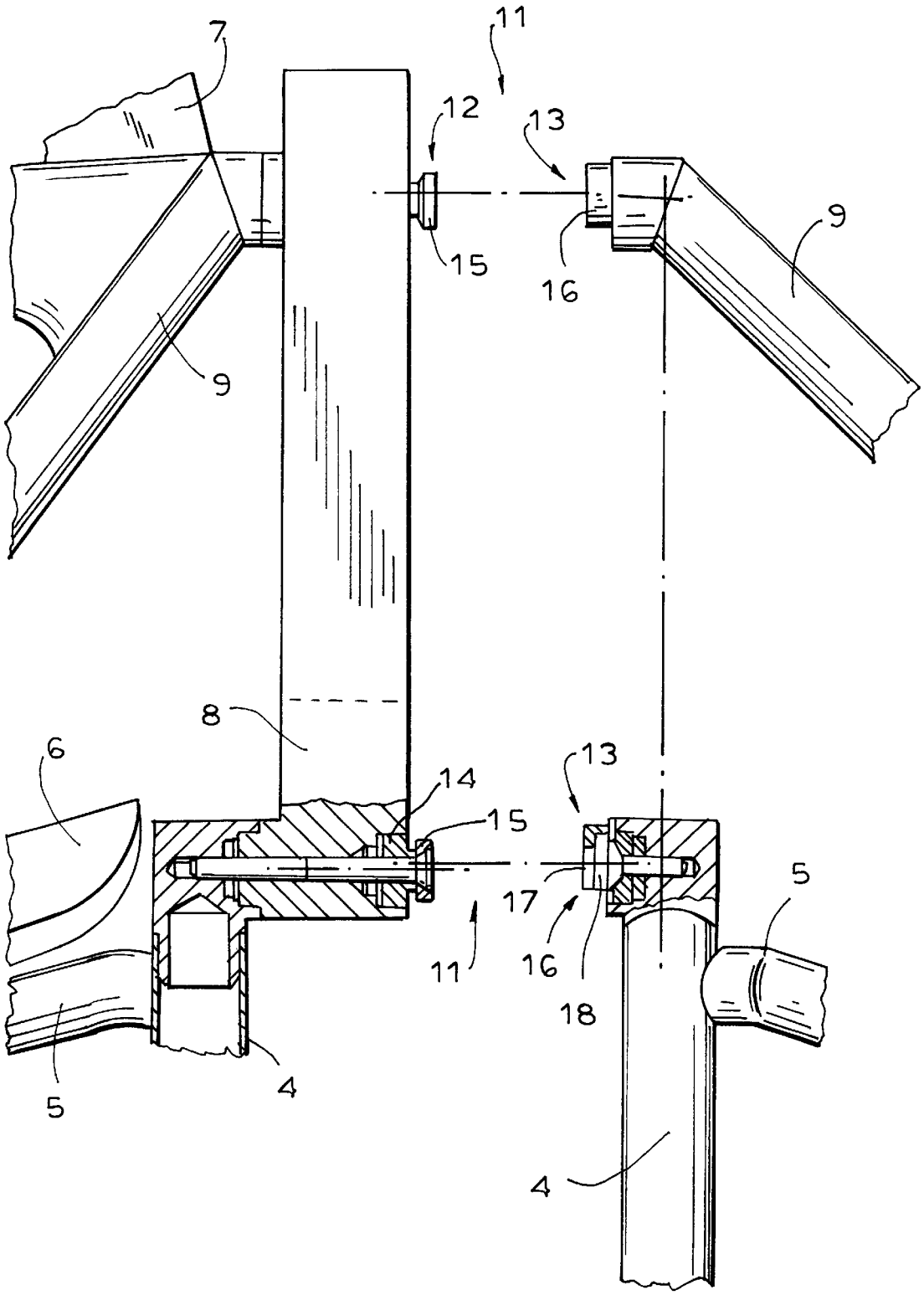
FIG. 3 is a front view partly in section of a detail of two chairs in accordance with the invention.
Figure 4:
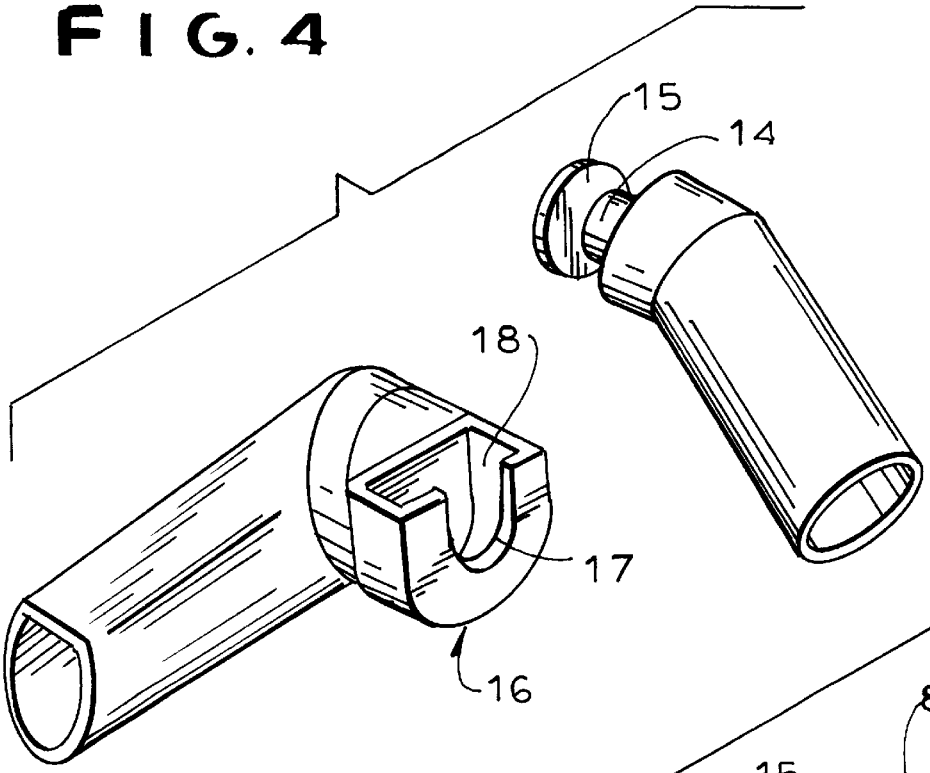
FIGS. 4 and 5 are perspective views of details of the inventive chairs.
Figure 5:
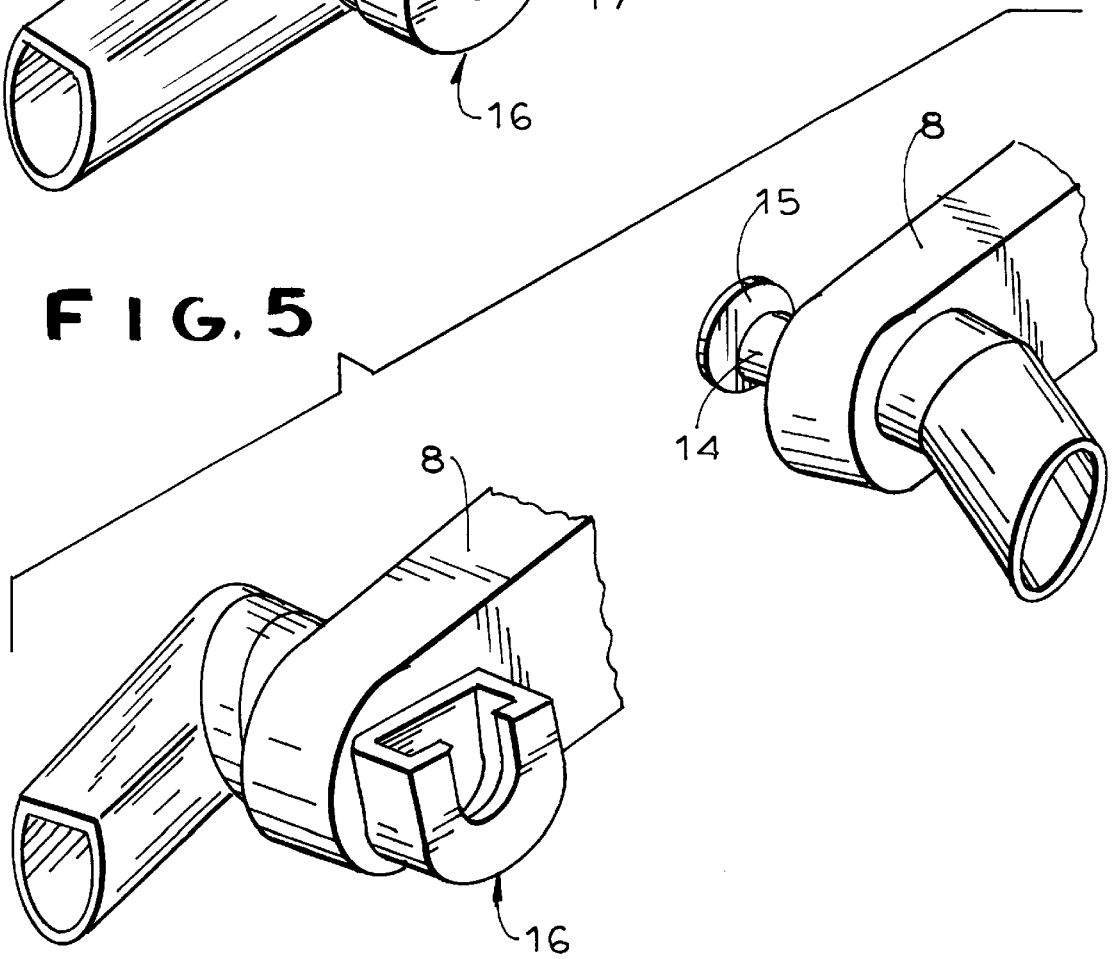

FIG. 3 shows how each connection point 11 is formed by a male coupling part or member 12 and a female coupling part or member 13. The male part 12 comprises a pin 14 having an enlarged disk head 15 and is attached either to the arm 8 or to a connecting piece 20 on the frame 5 or leg 4, although formation of the parts 12 and 13 unitarily with the frame 5 is also possible. The female part 13 comprises a socket 16 having a laterally open mouth or slot 17 and a groove 18 into which the head 15 can be fitted. The slot 17 can be open generally downward as indicated in FIG. 3 or upward as in FIGS. 4 and 6 and this part 13 can also be mounted either on a frame element 20 or on an arm 8. Thus it is possible for the end user to buy all two-arm chairs, or all no-arm chairs. Alternately it is possible to buy a quantity of chairs having, for example, left arms only that is equal to the number or rows to be made, and the balance in right-arm chairs. In any case it is no problem to interlock any chair with no, one, or two arms with another chair having no, one, or two arms as shown in FIG. 2. The members 12 and 13 are fairly small, much smaller than the adjacent frame parts, so that even when the chairs 1 according to the invention are used freestanding these members 12 and 13 do not constitute a hazard.

More particularly, the frame 5 and the arms 8 are each formed at each connection point with a cylindrical seat 19 into which fits mating cylindrical bases 21 of the head 15, of the socket 13, or of the arm 8, depending on chair configuration. The members 12 and 13 are secured in place with short screws 22 when there is no arm between the member 12 or 13 and the connection piece 20 or by long screws 23 when an arm 8 intervenes. Thus the chairs can easily be retrofitted with arms 8 if desired, or arms 8 can be removed.

Figure 6:
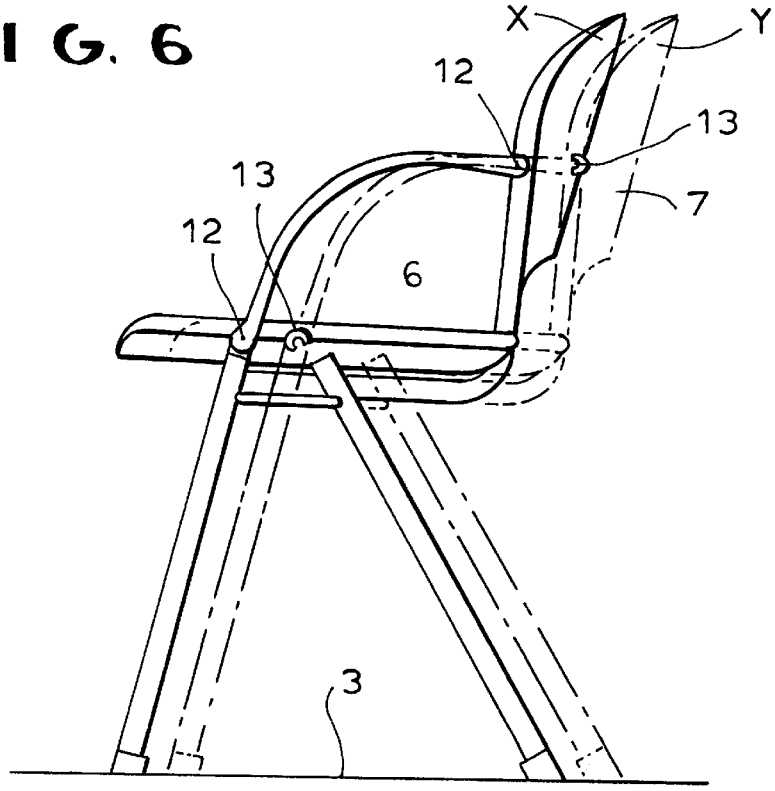
FIGS. 6 through 10 are side views illustrating how two chairs according to the invention are fitted together.
Figure 7:
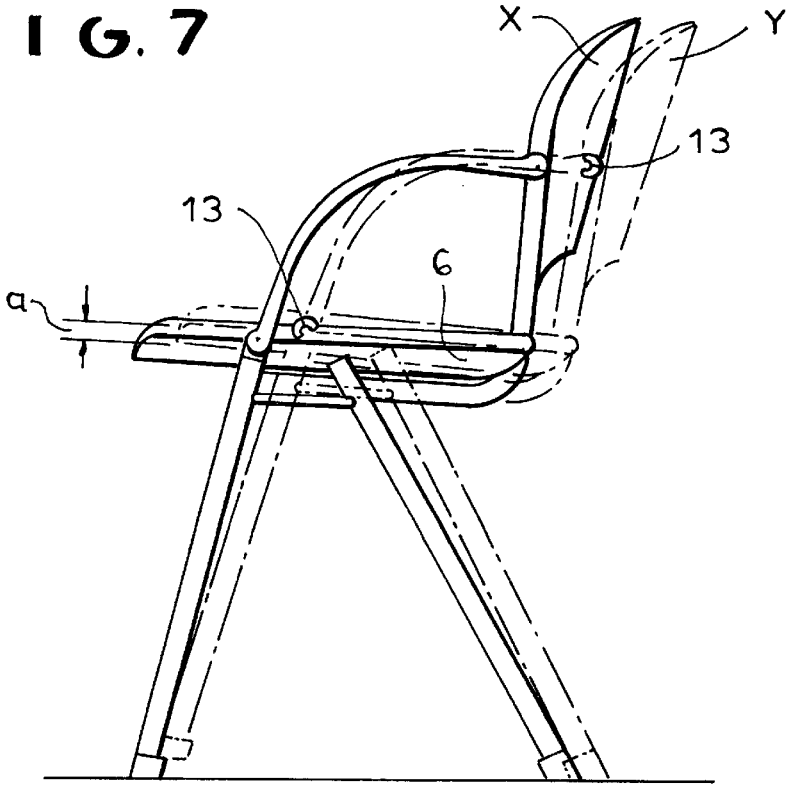
Figure 8:
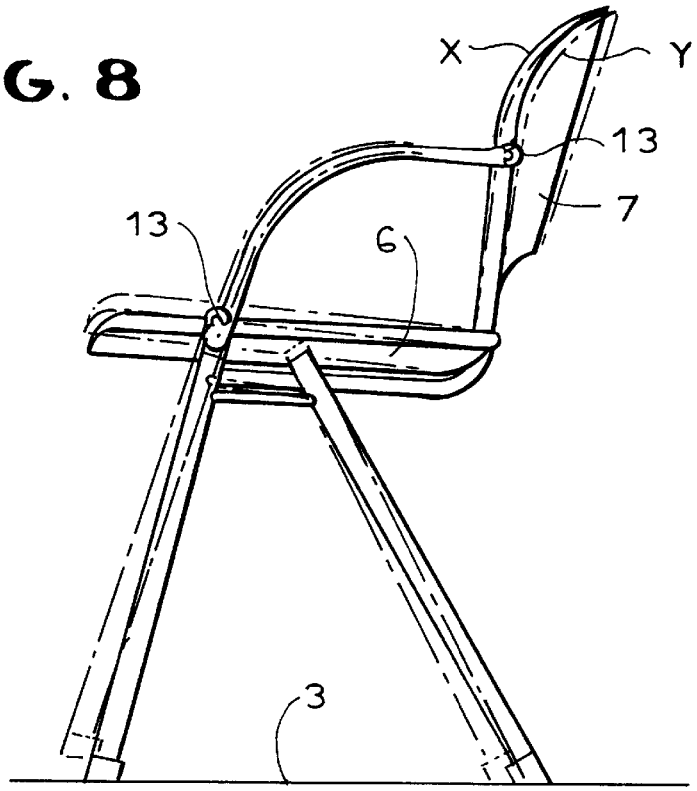
Figure 9:
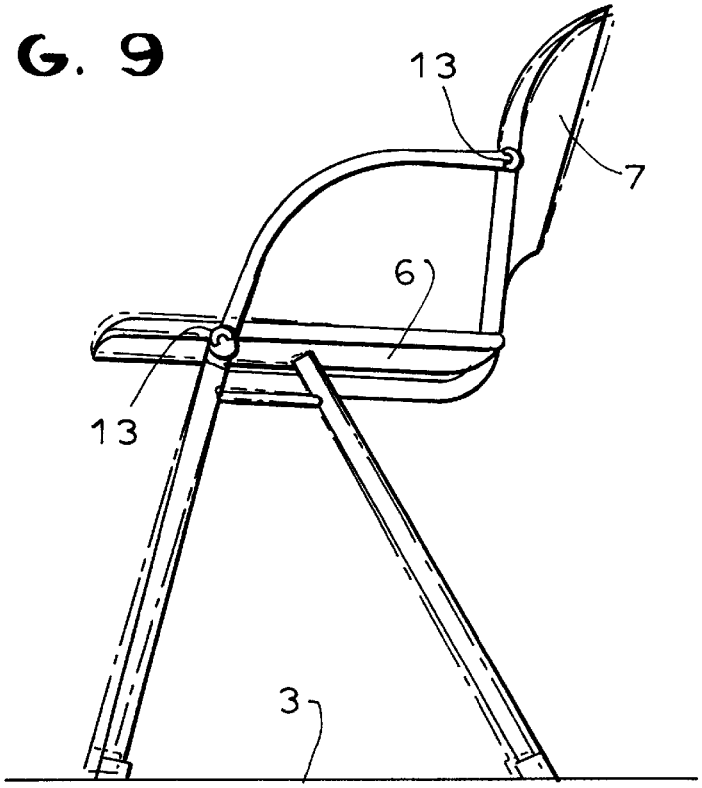
Figure 10:
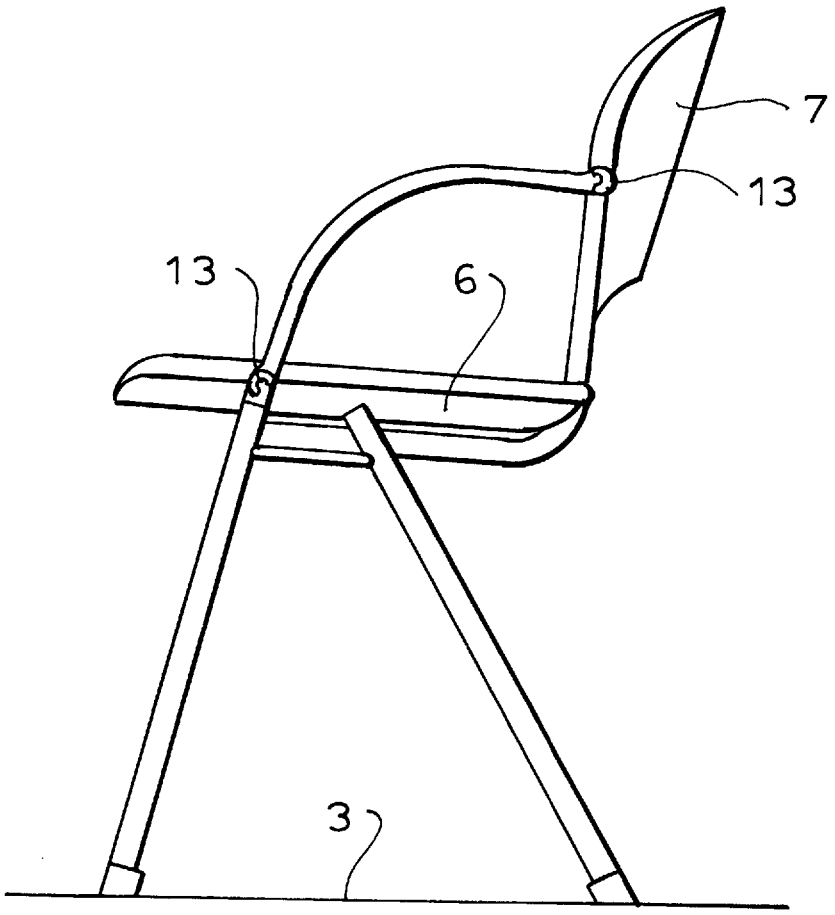

FIG. 6 shows how to start with two chairs 1 designated x and y are fitted together by setting chair x on the floor slightly ahead of chair y. Then as shown in FIG. 7 the front of chair y is lifted and slid forward into the position of FIG. 8, engaging the forwardly directed upper rear socket member 13 with the upper rear male member 12. Then the front part of chair y is dropped down (FIG. 9) to engage the downwardly and rearwardly open slot 17 of the lower front female member 13 over the lower front male member 12 to complete the assembly, leaving the chairs aligned as shown in FIG. 10. In this position a simple horizontal shove, either forward or backward, will not be sufficient to uncouple the chairs from each other. The chairs can only be separated by a compound movement—raising the chair front and then sliding the chair back—that is the opposite of the coupling movement. Thus if the end chairs of a row of thus interlocked chairs are secured to the floor, the entire row will be panic safe in that a simple lifting or horizontal push will not uncouple two chairs from each other. The same effect would be achieved by orienting the lower front member 13 so it opens horizontally backward with the upper rear member opening upward.

I claim:

1. A seating assembly comprising:

an armless chair having a frame, legs extending downward from the frame and having floor-engaging feet, a generally horizontal seat supported on the frame, and an upright back supported on the frame, the frame defining a pair of opposite sides between which lie the respective frame, legs, seat, and back;

an arm chair having a frame, legs extending downward from the frame and having floor-engaging feet, a generally horizontal seat supported on the frame, an upright back supported on the frame, and an arm fixed to the frame, the frame and arm defining a pair of opposite sides between which lie the respective frame, legs, seat, back, and arm;

a front female coupling member fixed on one side of each chair spaced a predetermined vertical front distance from a floor plane defined by the respective feet;

a front male coupling member fixed on the other side of each chair spaced a vertical front distance from the respective plane and engageable in the female member of an adjacent such chair, the frames, members, and arms being so constructed and positioned that the chairs can be nested atop one another;

a back female coupling member fixed on the one side of each chair spaced a predetermined vertical back distance from the floor plane and a predetermined horizontal distance from the respective front female coupling member; and a back male coupling member fixed on the other side of each chair spaced the vertical distance from the respective plane and the horizontal distance from the respective front male coupling member and engageable in the respective back female member of an adjacent such chair.

2. The seating assembly defined in claim 1 wherein the coupling members are at locations in a region of a stack of the chairs having a stack height defined by the vertical spacing of each chair above the underlying chair, the locations being defined by a horizontal extent of the arms and the stack height.

3. The seating assembly defined in claim 1 wherein the legs converge generally upwardly.

4. The seating assembly defined in claim 1 wherein the back coupling members of a chair define an upper axis and the front coupling members define a lower axis parallel to the upper axis.

5. The seating assembly defined in claim 1, further comprising screws securing the coupling members to the respective frames and arms.

6. The seating assembly defined in claim 1 wherein the coupling members of the arm chair are fixed to the respective arm.

7. The seating assembly defined in claim 1 wherein the frames and legs are formed of tubing of a predetermined diameter and the coupling members are of a substantially smaller diameter.

8. The seating assembly defined in claim 1 wherein each male coupling member is formed as a pin having a large laterally projecting head and each female coupling member is formed as a complementary laterally open seat.

9. The seating assembly defined in claim 8 wherein each seat has a groove receiving the respective head and a laterally open slot.

10. The seating assembly defined in claim 9 wherein each slot is basically U-shaped.

11. The seating assembly defined in claim 10 wherein the slot of at least one of the female coupling members of each chair opens generally vertically.

12. The seating assembly defined in claim 11 wherein the slot of the other of the female coupling members of each chair opens generally horizontally.

13. The seating assembly defined in claim 11 wherein the slots of the rear coupling female coupling members open horizontally forward and the slots of the front female coupling members open vertically downward and backward.

* * * * *